US008683820B2

(12) United States Patent
Lee et al.

(10) Patent No.: US 8,683,820 B2
(45) Date of Patent: Apr. 1, 2014

(54) REFRIGERATOR AND GUIDE MEMBER THAT GUIDES DISCHARGE OF DEFROST WATER

(75) Inventors: Youn Seok Lee, Seoul (KR); Jang Seok Lee, Seoul (KR); Min Kyu Oh, Seoul (KR); Kyeong Yun Kim, Seoul (KR); Su Nam Chae, Seoul (KR)

(73) Assignee: LG Electronics Inc., Seoul (KR)

( * ) Notice: Subject to any disclaimer, the term of this patent is extended or adjusted under 35 U.S.C. 154(b) by 1146 days.

(21) Appl. No.: 12/634,817

(22) Filed: Dec. 10, 2009

(65) Prior Publication Data

US 2010/0180620 A1 Jul. 22, 2010

(30) Foreign Application Priority Data

Jan. 21, 2009 (KR) ..... 10-2009-0005010

(51) Int. Cl.
*F25D 21/14* (2006.01)
*F25D 17/04* (2006.01)
*F25D 17/06* (2006.01)

(52) U.S. Cl.
USPC ..... 62/288; 62/285; 62/407; 62/414; 62/419; 62/513

(58) Field of Classification Search
USPC ..... 62/285, 288, 298, 407, 414, 419, 442, 62/449, 513
See application file for complete search history.

(56) References Cited

U.S. PATENT DOCUMENTS

| | | | | | |
|---|---|---|---|---|---|
| 3,004,400 | A | * | 10/1961 | Mann et al. | 62/156 |
| 3,122,899 | A | | 3/1964 | Costantini et al. | |
| 3,126,716 | A | * | 3/1964 | De Witte | 62/156 |
| 3,382,683 | A | * | 5/1968 | Wiljanen | 62/186 |
| 3,590,594 | A | * | 7/1971 | Arend | 62/117 |
| 3,712,078 | A | | 1/1973 | Maynard et al. | |
| 3,745,786 | A | * | 7/1973 | Laughlin et al. | 62/419 |
| 3,834,176 | A | * | 9/1974 | Clarke | 62/276 |
| 4,741,175 | A | * | 5/1988 | Schulze | 62/442 |
| 4,776,182 | A | * | 10/1988 | Gidseg | 62/448 |
| 5,086,627 | A | | 2/1992 | Borgen | |
| 5,284,023 | A | | 2/1994 | Silva et al. | |
| 5,531,267 | A | * | 7/1996 | Ahmed et al. | 165/124 |
| 5,622,059 | A | | 4/1997 | McClellan | |
| 5,729,997 | A | * | 3/1998 | Witsoe | 62/407 |
| 5,819,552 | A | * | 10/1998 | Lee | 62/407 |

(Continued)

FOREIGN PATENT DOCUMENTS

| | | | |
|---|---|---|---|
| CN | 1107569 | A | 8/1995 |
| CN | 1517642 | A | 8/2004 |

(Continued)

OTHER PUBLICATIONS

PCT International Search Report and Written Opinion dated Apr. 15, 2011 for Application No. PCT/KR2009/06859, 10 pages.

(Continued)

*Primary Examiner* — Ljiljana Ciric
(74) *Attorney, Agent, or Firm* — Fish & Richardson P.C.

(57) ABSTRACT

A refrigerator includes an air guide that is provided with a defrost water hole and that is inclined toward the defrost water hole. The air guide guides cold air discharged from the cold air fan to a guide duct and also guides, to the defrost water hole, defrost water generated at the cold air fan.

11 Claims, 7 Drawing Sheets

(56) References Cited

U.S. PATENT DOCUMENTS

| | | | | |
|---|---|---|---|---|
| 6,094,934 | A * | 8/2000 | Rand et al. | 62/440 |
| 6,381,981 | B1 * | 5/2002 | Yaddgo et al. | 62/372 |
| 6,467,859 | B2 | 10/2002 | Branz et al. | |
| 6,735,976 | B2 | 5/2004 | Lee | |
| 6,997,008 | B2 | 2/2006 | Lee et al. | |
| 7,003,973 | B2 | 2/2006 | Lee et al. | |
| 7,040,118 | B2 | 5/2006 | Jung | |
| 7,114,345 | B2 | 10/2006 | Kim et al. | |
| 7,185,509 | B2 | 3/2007 | Lee et al. | |
| 7,188,490 | B2 | 3/2007 | Jeong et al. | |
| 7,322,209 | B2 | 1/2008 | Hwang et al. | |
| 7,950,245 | B2 * | 5/2011 | Lee et al. | 62/285 |
| 7,950,247 | B2 * | 5/2011 | Lee et al. | 62/414 |
| 8,261,573 | B2 * | 9/2012 | Kim et al. | 62/419 |
| 2002/0093276 | A1 | 7/2002 | Kawakami | |
| 2004/0040338 | A1 | 3/2004 | Lee et al. | |
| 2004/0139759 | A1 | 7/2004 | Lee et al. | |
| 2004/0139763 | A1 | 7/2004 | Jeong et al. | |
| 2004/0144130 | A1 | 7/2004 | Jung | |
| 2004/0163408 | A1 | 8/2004 | Kim et al. | |
| 2004/0182100 | A1 | 9/2004 | Lee et al. | |
| 2005/0218766 | A1 | 10/2005 | Hwang | |

FOREIGN PATENT DOCUMENTS

| | | | |
|---|---|---|---|
| CN | 1517643 | A | 8/2004 |
| EP | 1394485 | A2 | 3/2004 |
| EP | 1439356 | A2 | 7/2004 |
| EP | 1443289 | A1 | 8/2004 |
| EP | 1443289 | B1 | 1/2011 |
| JP | 7-19704 | | 1/1995 |
| JP | 10-019445 | A | 1/1998 |
| JP | 2003-148857 | A | 5/2003 |
| JP | 2004-116874 | A | 4/2004 |
| JP | 2004-333093 | A | 11/2004 |

OTHER PUBLICATIONS

U.S. Office Action dated Nov. 1, 2010 for U.S. Appl. No. 12/634,849, 14 pages.

Chinese Office Action dated Oct. 12, 2012 for Application No. 2009-80156782, with English translation, 13 pages.

Chinese Office Action dated Nov. 29, 2012 for Application No. 2009-80156781 with English Translation, 14 pages.

* cited by examiner

REFRIGERATOR AND GUIDE MEMBER THAT GUIDES DISCHARGE OF DEFROST WATER

CROSS REFERENCE TO RELATED APPLICATION

This application claims the benefit of Korean Patent Application No. 10-2009-0005010, filed on Jan. 21, 2009, which is hereby incorporated by reference as if fully set forth herein.

FIELD

The present disclosure relates to refrigerator technology.

BACKGROUND

A refrigerator is used to supply cold air generated at an evaporator to a storage compartment (e.g., a refrigerating and/or freezing compartment) to maintain freshness of various food products stored in the storage compartment. Such a refrigerator includes a body, in which a storage compartment is defined to store food in a low-temperature state therein. A door is mounted to a front side of the body to open or close the storage compartment.

A cooling cycle is included in the refrigerator to cool the storage compartment through circulation of a refrigerant. A machine compartment also is defined in the body to accommodate a plurality of electric elements used to configure the cooling cycle.

For instance, the cooling cycle includes a compressor to perform a temperature/pressure increasing operation upon a low-temperature/low-pressure gaseous refrigerant such that the low-temperature/low-pressure gaseous refrigerant is changed into a high-temperature/high-pressure gaseous refrigerant. The cooling cycle also includes a condenser to condense the refrigerant supplied from the compressor, using ambient air, an expansion valve to perform a pressure reducing operation upon the refrigerant supplied from the condenser such that the refrigerant is expanded, and an evaporator to evaporate the refrigerant emerging from the expansion valve in a low pressure state, thereby absorbing heat from the interior of the refrigerator.

A blowing fan is installed in the machine compartment to cool the compressor and condenser. Through holes are defined at opposite sides of the machine compartment to allow introduction and discharge of ambient air, respectively.

In accordance with the above-mentioned structure, ambient air is introduced into the interior of the machine compartment through one of the through holes (e.g., an inlet hole) when the blowing fan rotates. The introduced air passes along the condenser and compressor, and is then outwardly discharged from the machine compartment through the other through hole (e.g., an outlet hole). During this procedure, the condenser and compressor are cooled by the ambient air.

A refrigerator may be a top mount type in which freezing and refrigerating compartments are vertically arranged, and freezing and refrigerating compartment doors are mounted to the freezing and refrigerating compartments to open or close the freezing and refrigerating compartments, respectively. A refrigerator also may be a bottom freezer type in which freezing and refrigerating compartments are vertically arranged, hinged refrigerating compartment doors are pivotally mounted to left and right sides of the refrigerating compartment, and a drawer type freezing compartment door is mounted to the freezing compartment such that the freezing compartment door slides in forward and rearward directions of the freezing compartment to open or close the freezing compartment. A refrigerator further may be a side-by-side type in which freezing and refrigerating compartments are horizontally arranged for an increased refrigerator size, and freezing and refrigerating compartment doors are pivotally mounted to the freezing and refrigerating compartments in a side-by-side fashion to open or close the freezing and refrigerating compartments, respectively.

SUMMARY

In one aspect, a refrigerator includes a body, a storage compartment defined in a first portion of the body, and a cold air generating compartment defined in an upper portion of the body. The upper portion of the body is positioned above the storage compartment when the refrigerator is oriented in an ordinary operating orientation. The refrigerator also includes an evaporator positioned in the cold air generating compartment and a cold air fan positioned in the cold air generating compartment and configured to promote movement of air within the cold air generating compartment in a flow direction that passes over the evaporator. The refrigerator further includes a guide member positioned in the cold air generating compartment, configured to guide defrost water generated at the cold air fan through a discharge hole, and configured to guide cold air discharged by the cold air fan through a cold air outlet toward the storage compartment. The discharge hole is different than the cold air outlet.

Implementations may include one or more of the following features. For example, a cold air inlet may be positioned at the cold air generating compartment. In this example, the cold air flowing from the storage compartment toward the cold air generating compartment may pass through the cold air inlet, the evaporator may be arranged adjacent to the cold air inlet, and the cold air fan and the guide member may be arranged adjacent to the cold air outlet.

In addition, the refrigerator may include a guide duct connected to the cold air outlet and configured to guide the cold air passing through the cold air outlet to the storage compartment. The refrigerator also may include an orifice arranged around the cold air fan. The guide member may be arranged beneath the orifice, may be inclined toward the cold air outlet positioned beneath the cold air fan, and may be configured to guide the cold air discharged from the cold air fan toward the cold air outlet. The guide member may have a curved shape corresponding to a shape of a peripheral edge of the cold air fan.

In some examples, the discharge hole may be a defrost water hole positioned at the guide member and configured to discharge, out of the guide member, defrost water dripping from the cold air fan onto the guide member during a defrosting operation of the evaporator. In these examples, guide grooves may be positioned at an upper surface of the guide member and configured to guide a flow of defrost water. The guide grooves may extend radially from the defrost water hole.

Further, the refrigerator may include a protrusion rib that extends from a lower end of the guide member to limit flow of defrost water generated at the cold air fan toward the cold air outlet. The refrigerator also may include a drain pan that is arranged beneath the evaporator and extends to a position beneath the discharge hole that is configured to receive defrost water discharged through the discharge hole, and that is configured to receive defrost water from the evaporator.

In some implementations, the refrigerator may include a guide plate positioned at a corner of the cold air generating compartment and configured to guide cold air discharged toward an upper portion of the cold air generating compartment to a lower portion of the cold air generating compartment where the cold air outlet is arranged. In these implementations, the guide plate may have an arc shape concave toward the cold air fan.

In another aspect, a refrigerator includes a body, a storage compartment defined in a first portion of the body, and a cold air generating compartment defined in an upper portion of the body and separated from the storage compartment. The upper portion of the body may be positioned above the storage compartment when the refrigerator is oriented in an ordinary operating orientation. The refrigerator also includes an evaporator positioned in the cold air generating compartment and a cold air fan positioned in the cold air generating compartment and configured to promote movement of air within the cold air generating compartment in a flow direction that passes over the evaporator. The refrigerator further includes a guide member positioned in the cold air generating compartment and configured to guide cold air discharged by the cold air fan toward the storage compartment and guide defrost water generated at the cold air fan away from the storage compartment.

Implementations may include one or more of the following features. For example, the guide member may be arranged beneath the cold air fan, may be inclined in a downward direction, and may have a height that gradually reduces as the guide member extends from opposite lateral edges of the guide member to a central portion of the guide member. The configuration of the guide member may cause defrost water to, when the refrigerator is oriented in an ordinary operating orientation, be collected at the central portion of the guide member by force of gravity.

The guide member may include a protrusion rib positioned at a lower end edge of the guide member to reduce a likelihood of overflow of the defrost water. The guide member also may include a defrost water hole defined at the central portion and configured to guide the defrost water to be discharged from the guide member. The guide member further may include guide grooves configured to guide a flow of the defrost water to the defrost water hole.

In addition, the guide grooves may extend from the opposite lateral edges of the guide member to the central portion and may cause the defrost water to flow to the defrost water hole. The refrigerator may include a guide plate positioned at a corner of the cold air generating compartment and may have an arc shape concave toward the cold air fan. The refrigerator also may include a drain pan that is arranged beneath the evaporator and extends to a position beneath a discharge hole of the guide member, that is configured to receive defrost water discharged through the discharge hole, and that is configured to receive defrost water from the evaporator.

In some implementations, the refrigerator may include a cold air inlet positioned at the cold air generating compartment. The cold air flowing from the storage compartment toward the cold air generating compartment may pass through the cold air inlet. In these implementations, the refrigerator may include a cold air outlet positioned at the cold air generating compartment. The cold air flowing from the cold air generating compartment toward the storage compartment may pass through the cold air outlet. The evaporator may be arranged adjacent to the cold air inlet and the cold air fan and the guide member may be arranged adjacent to the cold air outlet.

In some examples, the refrigerator may include a guide duct connected to the cold air outlet and configured to guide the cold air passing through the cold air outlet to the storage compartment. In these examples, the guide member may be inclined toward the cold air outlet, may be positioned beneath the cold air fan, may be configured to guide the cold air discharged from the cold air fan toward the storage compartment by guiding the cold air discharged from the cold air fan toward the cold air outlet, and may be configured to guide defrost water generated at the cold air fan away from the storage compartment by guiding the defrost water generated at the cold air fan toward a discharge hole defined in the guide member that is different than the cold air outlet.

DETAILED DESCRIPTION

Figure 1:
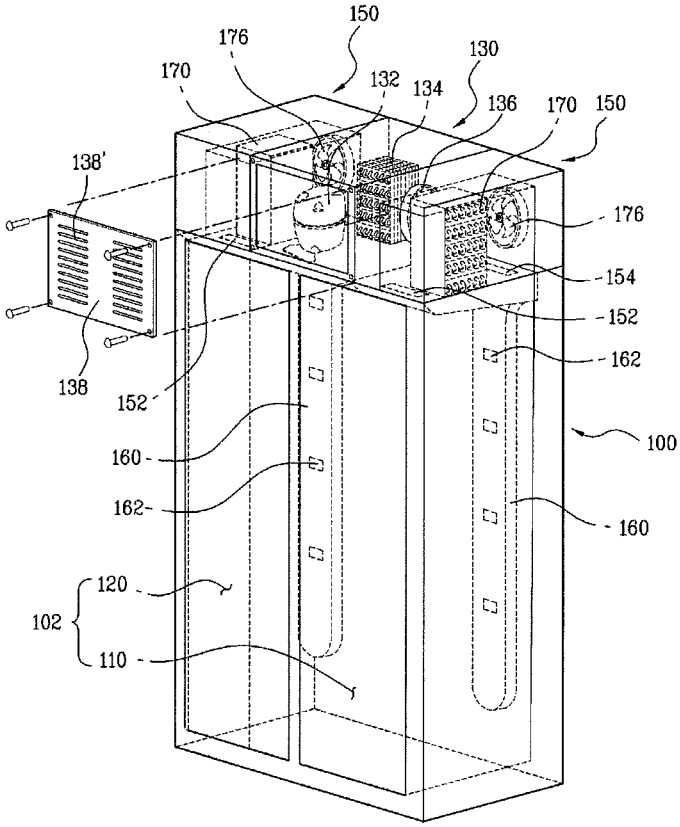
FIG. 1 is a perspective view illustrating an example configuration of a refrigerator.
Figure 2:
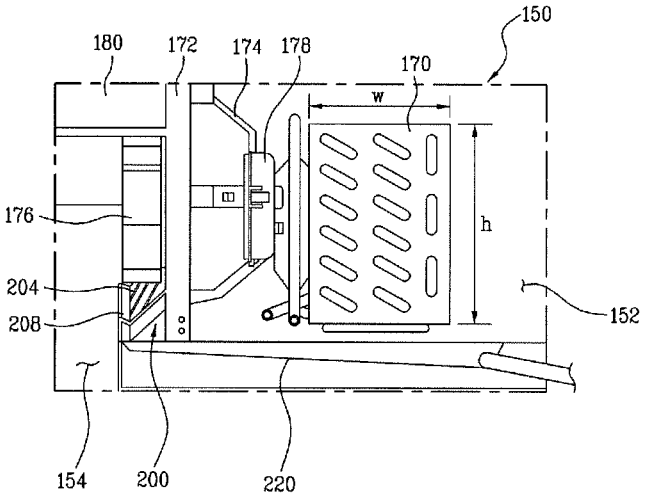
FIGS. 2 and 3 are a side view and a sectional view illustrating an example configuration of the refrigerator.
Figure 3:
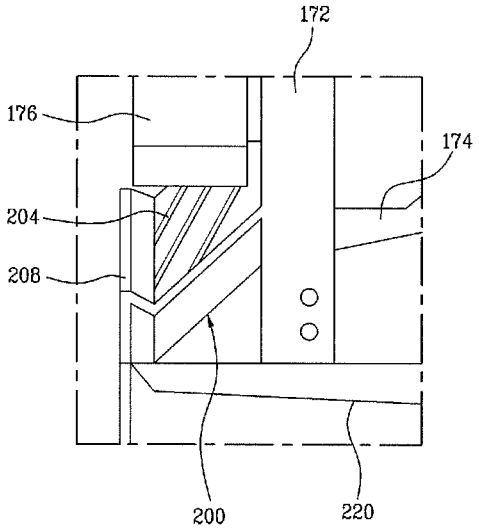
Figure 4:
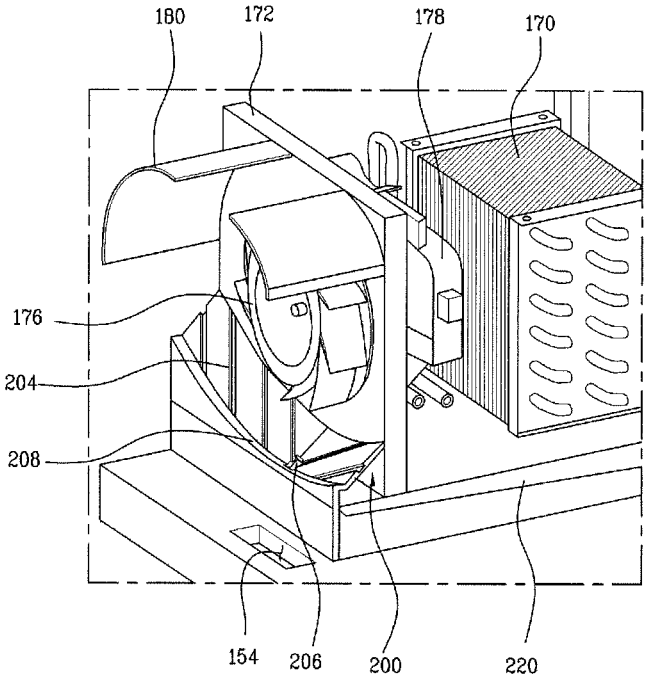
FIGS. 4 and 5 are perspective views illustrating an example configuration of the refrigerator.
Figure 5:
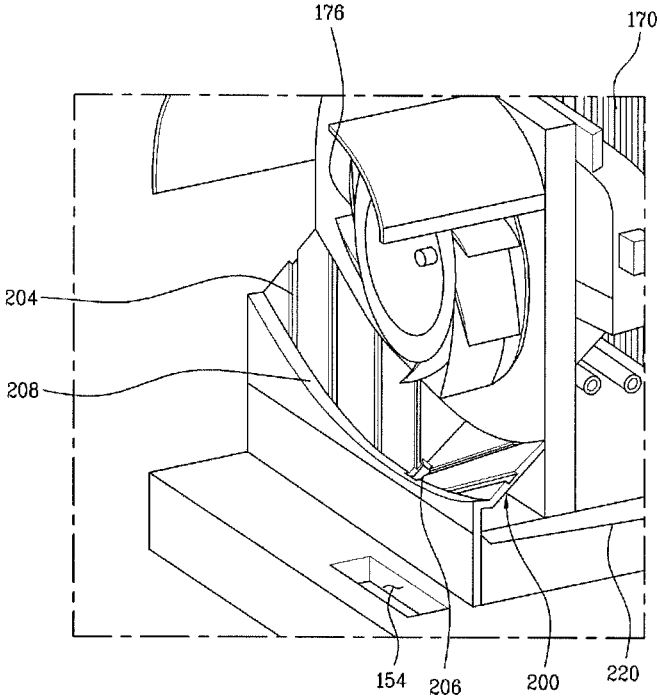

FIG. 1 illustrates an example configuration of a refrigerator. FIGS. 2 and 3 illustrate an example configuration of a refrigerator. FIGS. 4 and 5 illustrate an example configuration of a refrigerator.

As shown in the drawings, in a body 100 that defines a frame of the refrigerator, a storage compartment 102 is defined. The storage compartment 102 is a space to store food in a low-temperature state using cold air generated around an evaporator 170. A plurality of racks are vertically arranged in the storage compartment 102. A drawer type storage compartment may be defined beneath the racks.

The storage compartment 102 includes a refrigerating compartment 110 and a freezing compartment 120. The refrigerating compartment 110 and freezing compartment 120 are separated from each other by a partition wall so that they define separate storage spaces.

A machine compartment 130 also is defined in the body 100. The machine compartment 130 is arranged at an upper portion of the body 100. In other examples, the machine compartment 130 may be arranged at a lower portion of the body 100 in accordance with design conditions. An accommodation space is defined in the machine compartment 130. In the accommodation space, one or more elements of a refrigeration cycle are accommodated. For instance, a compressor 132, a condenser 134, an expansion valve, and a blowing fan 136 are arranged in the machine compartment 130.

The compressor 132 functions to compress a low-temperature/low-pressure gaseous refrigerant circulating the refrigeration cycle into a high-temperature/high-pressure gaseous refrigerant. The refrigerant emerging from the compressor 132 is introduced into the condenser 134.

The condenser 134 phase-changes the refrigerant compressed by the compressor 132 into a normal-temperature/high-pressure liquid refrigerant, through heat exchange. The condenser 134 includes a tubular refrigerant pipe repeatedly bent multiple times. The refrigerant pipe of the condenser 134 is repeatedly bent multiple times to have continuous pipe portions spaced apart from one another by a uniform gap. In accordance with the repeated bending of the refrigerant pipe, the condenser 134 generally has a rectangular hexahedral shape. The blowing fan 136 is arranged in the vicinity of the condenser 134, to blow ambient air toward the condenser 134.

The refrigerant emerging from the condenser 134 passes through the expansion valve. The expansion valve has a reduced diameter, as compared to those of other parts, to reduce the pressure of the refrigerant emerging from the condenser 134, and thus to expand the refrigerant.

A cover member 138 is arranged at a front side of the machine compartment 130 to screen the accommodation space. Through holes 138' are defined through the cover member 138 to allow ambient air to be introduced into the machine compartment 130 or to allow air present in the machine compartment 130 to be outwardly discharged.

A cold air generating compartment 150 also is defined in the body 100. The cold air generating compartment 150 is a space in which one or more components that generate cold air are installed in order to maintain the storage compartment 102 at low temperature. The cold air generating compartment 150 has a rectangular hexagonal shape extending from a front side of the body 100 to a rear side of the body 100 in a longitudinal direction. Cold air emerging from the storage compartment 102 is introduced into a front side of the cold air generating compartment 150, and is then discharged out of a rear side of the cold air generating compartment 150 after being cooled in the cold air generating compartment 150. In some examples, a structure, in which cold air is introduced into the rear side of the cold air generating compartment 150 and is then discharged out of the front side of the cold air generating compartment 150, may be used. As shown in FIG. 1, the cold air generating compartment 150 is arranged at the upper portion of the body 100, adjacent to the machine compartment 130, while being separated from the storage compartment 102 by one or more walls.

A cold air inlet 152 and a cold air outlet 154 are provided at the cold air generating compartment 150. The cold air inlet 152 is a port through which cold air from the storage compartment 102 is introduced into the cold air generating compartment 150. The cold air outlet 154 is a port through which cold air is discharged from the cold air generating compartment 150 so as to be guided to the storage compartment 102.

A guide duct 160 is provided at the body 100. The guide duct 160 defines a path to circulate the cold air generated by the evaporator 170 to the storage compartment 102. The guide duct 160 communicates with the storage compartment 102 and cold air generating compartment 150. The guide duct 160 is also connected to the cold air outlet 154.

As shown in FIG. 1, the guide duct 160 extends from the cold air generating compartment 150 to a lower portion of the storage compartment 102.

The guide duct 160 has an inlet connected to the cold air outlet 154. In order to reduce introduction of defrost water generated at a cold air fan 176, the inlet of the guide duct 160 is arranged at one end of the cold air generating compartment 150 beyond an installation region of the cold air fan 176 in a vertical direction.

A cold air outlet 162 is positioned at the guide duct 160. The cold air outlet 162 is defined through one wall of the guide duct 160 such that it is opened to the storage compartment 102. As shown in FIG. 1, a plurality of cold air outlets 162 are provided. The cold air outlets 162 supply cold air from the guide duct 160 to the storage compartment 102. The cold air outlet 162 may be defined between the top of the storage compartment 102 and an uppermost one of the racks and between adjacent ones of the racks. In the cold air generating compartment 150, the evaporator 170 and cold air fan 176 are horizontally arranged.

The evaporator 170 is configured to absorb heat from the surroundings when a liquid present in the evaporator 170 is changed into a gas and, thereby, decreases the temperature of the surroundings. Thus, the evaporator 170 absorbs heat from the surroundings as the refrigerant emerging from the expansion valve is evaporated in a low-pressure state.

As shown in FIGS. 2 and 3, the evaporator 170 has a vertical length h perpendicular to a flow direction of cold air along the evaporator 170 and a horizontal length w parallel to the flow direction of cold air such that the vertical length h is longer than the horizontal length w. In the evaporator 170, the vertical length h perpendicular to the flow direction of cold air along the evaporator 170 may be longer than the horizontal length w parallel to the flow direction of cold air because the cold air generating compartment 150 extends in a horizontal direction, and cold air is introduced into and discharged out of the cold air generating compartment 150 at front and rear sides of the cold air generating compartment 150, respectively.

An orifice 172 is provided in the cold air generating compartment 150. The orifice 172 is arranged adjacent to the evaporator 170 at a rear portion of the cold air generating compartment 150. The orifice 172 includes an orifice hole and a motor support 174.

The cold air fan 176 is connected to the orifice hole of the orifice 172. The cold air fan 176 is arranged over a drain pan 220 described in more detail below. The cold air fan 176 discharges air as vanes thereof rotate to provide ventilation or heat removal. The cold air fan 176 generates a flow of cold air circulating the storage compartment 102, cold air generating compartment 150, etc.

A fan motor 178 is supported by the motor support 174. The fan motor 178 is arranged at the orifice 172 adjacent to the evaporator 170. The fan motor 178 provides a driving force to drive the cold air fan 176.

Guide plates 180 are provided at corners of the cold air generating compartment 150, in particular, upper corners, to change a flow direction of cold air. The guide plates 180 are arranged at opposite sides of the top of the orifice 172. Each guide plate 180 guides cold air discharged toward an upper portion of the cold air generating compartment 150 to a lower portion of the cold air generating compartment 150 where the cold air outlet 154 is arranged. Each guide plate 180 has an arc shape concave toward the cold air fan 176.

A guide member 200 is provided at the cold air generating compartment 150. The guide member 200 has an arc shape such that it surrounds a peripheral edge of the cold air fan 176 while being spaced apart from the cold air fan 176 in a blowing direction of the cold air fan 176.

The guide member 200 is downwardly inclined from one surface of the orifice 172 to which the cold air fan 176 is mounted toward the inlet of the guide duct 160. In some implementations, the guide member 200 has a height that gradually reduces as it extends from each lateral edge thereof to a central portion thereof.

In accordance with this structure, defrost water at the cold air fan 176 can flow toward the central portion of the guide member 200 after dripping onto the guide member 200.

The guide member 200 functions to change the flow direction of the cold air discharged by the cold air fan 176 because it is inclined with respect to the blowing direction of the cold air fan 176. For instance, the cold air flowing in a direction perpendicular to the longitudinal direction of the cold air generating compartment 150 by the cold air fan 176 is guided to the inlet of the guide duct 160 by the guide member 200.

Guide grooves 204 are defined on one surface of the guide member 200 facing the cold air fan 176 are configured to guide the flow of defrost water. The guide grooves 204 extend radially from a defrost water hole 206, which is described in more detail below. For example, the guide grooves 204 guide a flow direction of defrost water on the surface of the guide member 200 such that the defrost water flows toward the defrost water hole 206. The guide grooves 204 may have a comb shape or an oblique line shape.

The defrost water hole 206 is provided at a lowermost portion of the guide member 200 and configured to discharge defrost water. The defrost water hole 206 is defined through the guide member 200. The defrost water hole 206 guides defrost water flowing downwardly along the surface of the guide member 200 to the drain pan 220, which is described in more detail below. In some examples, a plurality of defrost water holes 206 may be provided. In these examples, each defrost water hole 206 may have a slit shape extending along an edge of the guide member 200.

A protrusion rib 208 is defined along a lower end edge of the guide member 200. The protrusion rib 208 reduces the likelihood of (e.g., prevents) defrost water generated at the cold air fan 176 from being introduced into the guide duct 160.

A drain pan 220 is provided in the cold air generating compartment 150. The drain pan 220 is arranged beneath the evaporator 170 in the cold air generating compartment 150. The drain pan 220 extends from the evaporator 170 to a position beneath the cold air fan 176. For instance, the drain pan 220 extends from the evaporator 170 to a position corresponding to the defrost water hole 206. Accordingly, the drain pan 220 collects not only defrost water generated at the evaporator 170, but also defrost water generated at the cold air fan 176, and then outwardly discharges the collected defrost water.

Figure 6:
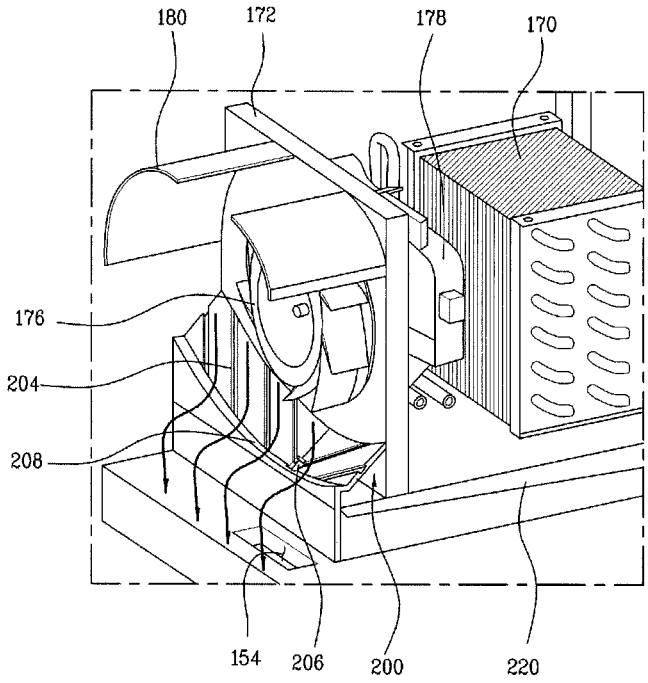
FIGS. 6 and 7 are schematic views illustrating example flows of cold air and defrost water guided by the guide member.
Figure 7:
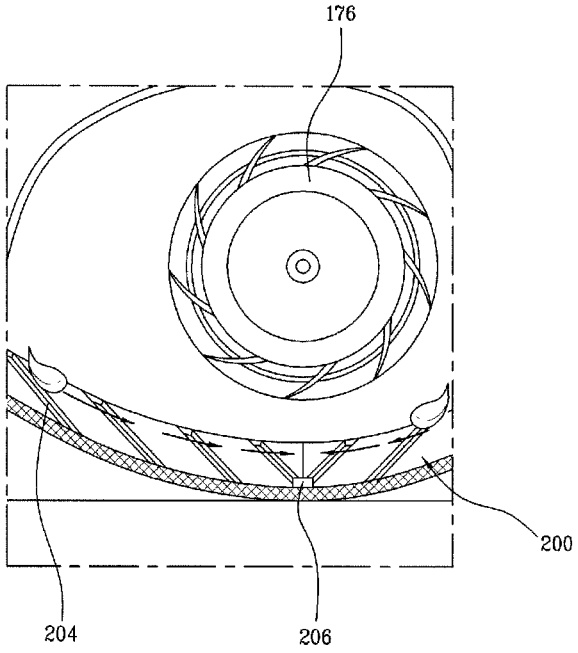

FIGS. 6 and 7 illustrate example flows of cold air and defrost water guided by the guide member. In the body 100, cold air present in the storage compartment 102 is introduced into the cold air generating compartment 150 after flowing through the cold air inlet 152. The cold air is cooled in the cold air generating compartment 150 in accordance with heat exchange thereof with the evaporator 170. The cold air is then again introduced into the storage compartment 102 after sequentially passing through the cold air outlet 154 and guide duct 160.

Thus, heat exchange is performed in the cold air generating compartment 150 arranged at the upper portion of the body 100. Since the cold air generating compartment 150 extends in forward and rearward directions of the body 100, and the evaporator 170 and cold air fan 176 are installed in the forward and rearward directions of the body 100, the installation of the evaporator 170 and cold air fan 176 can be achieved substantially irrespective of the height of the cold air generating compartment 150, as compared to the case in which the evaporator 170 and cold air fan 176 are vertically arranged.

Also, the evaporator 170 is configured such that the length h thereof perpendicular to the flow direction of cold air along the evaporator 170 is longer than the horizontal length w thereof parallel to the flow direction of cold air. In the evaporator 170 having the above-described structure, the length of a flow path, through which cold air flows along the evaporator 170, is reduced for a constant heat exchange area, as compared to a structure in which the length of the evaporator perpendicular to the flow direction of cold air is shorter than the horizontal length of the evaporator parallel to the flow direction of cold air. As a result, the flow resistance of cold air is reduced, as compared to the latter structure.

As shown in FIG. 6, the cold air fan 176 discharges cold air flowing in a longitudinal direction of the cold air generating compartment 150 after perpendicularly bending the flow direction of the cold air in a centrifugal direction of the cold air fan 176. The guide member 200 is inclined with respect to the centrifugal direction of the cold air fan 176 and guides the cold air to the inlet of the guide duct 160.

Using the guide member 200, which extends along the centrifugal direction of the cold air fan 176, as described above, it is possible to guide the cold air discharged from the cold air fan 176 to the guide duct 160 with low or negligible resistance.

As shown in FIG. 7, defrost water falling vertically after being generated at the cold air fan 176 flows to the defrost water hole 206 defined through the guide member 200 along the guide grooves 204 defined on the surface of the guide member 200.

In this example, if the defrost water flowing downwardly along the surface of the guide member 200 enters the guide duct 160, it may be introduced into the storage compartment 102. To this end, the protrusion rib 208 is defined at one end of the guide member 200 reduces the likelihood of (e.g., prevents) the defrost water entering the guide duct 160.

Where the evaporator 170 and cold air fan 176 are vertically arranged, defrost water generated at the evaporator 170 and defrost water generated at the cold air fan 176 drip onto the same position. However, where the evaporator 170 and cold air fan 176 are horizontally arranged, defrost water generated at the evaporator 170 and defrost water generated at the cold air fan 176 drip onto different positions, respectively. To cover the different positions, the drain pan 220 extends from a position beneath the evaporator 170 to a position beneath the cold air fan 176. As such, the drain pan 220 receives both the defrost water generated at the evaporator 170 and the defrost water generated at the cold air fan 176.

In some implementations, the air guide provided with the defrost water hole is inclined with respect to the centrifugal direction of the cold air fan. Accordingly, the air guide not only guides cold air discharged from the cold air fan to the guide duct, but also guides, to the defrost water hole, defrost water falling in the centrifugal direction of the cold air fan. Thus, removal of defrost water and circulation of cold air can be achieved.

Also, in some examples, the drain pan extends from a position beneath the evaporator to a position beneath the cold air fan. Accordingly, the drain pan can remove both the defrost water generated at the evaporator and the defrost water generated at the cold air fan. Thus, the configuration to remove defrost water may be simplified.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator comprising:

a body;

a storage compartment defined in a first portion of the body;

a cold air generating compartment defined in an upper portion of the body, the upper portion of the body being positioned above the storage compartment;

an evaporator positioned in the cold air generating compartment;

a cold air fan positioned in the cold air generating compartment and configured to promote movement of air within the cold air generating compartment in a flow direction that passes over the evaporator; and a guide member positioned in the cold air generating compartment, configured to guide defrost water generated at the cold air fan through a discharge hole, and configured to guide any cold air discharged by the cold air fan through a cold air outlet toward the storage compartment, the discharge hole being different than the cold air outlet, wherein the discharge hole is positioned at a space to which air discharged from the cold air fan moves.

2. The refrigerator according to claim 1, further comprising:

a cold air inlet positioned at the cold air generating compartment, wherein any cold air flowing from the storage compartment toward the cold air generating compartment passes through the cold air inlet;

wherein the evaporator is arranged adjacent to the cold air inlet, wherein the cold air fan and the guide member are arranged adjacent to the cold air outlet.

3. The refrigerator according to claim 2, further comprising:

a guide duct connected to the cold air outlet and configured to guide any cold air passing through the cold air outlet to the storage compartment.

4. The refrigerator according to claim 2, further comprising:

an orifice arranged around the cold air fan, wherein the guide member is arranged beneath the orifice, is inclined toward the cold air outlet positioned beneath the cold air fan, and is configured to guide any cold air discharged from the cold air fan toward the cold air outlet.

5. The refrigerator according to claim 4, wherein the guide member has a curved shape corresponding to a shape of a peripheral edge of the cold air fan.

6. The refrigerator according to claim 2, wherein the discharge hole is a defrost water hole positioned at the guide member and configured to discharge, out of the guide member, defrost water dripping from the cold air fan onto the guide member during a defrosting operation of the evaporator.

7. The refrigerator according to claim 6, further comprising:

guide grooves positioned at an upper surface of the guide member and configured to guide a flow of defrost water, the guide grooves extending radially from the defrost water hole.

8. The refrigerator according to claim 2, further comprising:

a protrusion rib that extends from a lower end of the guide member to limit flow of defrost water generated at the cold air fan toward the cold air outlet.

9. The refrigerator according to claim 2, further comprising a drain pan that is arranged beneath the evaporator and extends to a position beneath the discharge hole that is configured to receive defrost water discharged through the discharge hole, and that is configured to receive defrost water from the evaporator.

10. The refrigerator according to claim 1, further comprising:

a guide plate positioned at a corner of the cold air generating compartment and configured to guide any cold air discharged toward an upper portion of the cold air generating compartment to a lower portion of the cold air generating compartment where the cold air outlet is arranged.

11. The refrigerator according to claim 10, wherein the guide plate has an arc shape that is concave in a direction toward the cold air fan.

* * * * *